US006634528B2

(12) United States Patent
Hurtgam

(10) Patent No.: US 6,634,528 B2
(45) Date of Patent: Oct. 21, 2003

(54) GOLF ACCESSORY HOLDER AND CLIP THEREFOR

(76) Inventor: Mervin Ward Hurtgam, 14 Thomas Jefferson La., Amherst, NY (US) 14226-3806

( * ) Notice: Subject to any disclaimer, the term of this patent is extended or adjusted under 35 U.S.C. 154(b) by 0 days.

(21) Appl. No.: 09/849,725

(22) Filed: May 7, 2001

(65) Prior Publication Data

US 2002/0162866 A1 Nov. 7, 2002

(51) Int. Cl.[7] ..... A45F 5/00
(52) U.S. Cl. ..... 224/251; 224/918
(58) Field of Search ..... 224/251, 918, 224/666, 268, 269, 932, 933; 473/405–407, 408; 206/315.5, 315.1, 315.3

(56) References Cited

U.S. PATENT DOCUMENTS

| | | | | | |
|---|---|---|---|---|---|
| D165,253 | S | * | 11/1951 | Wang | D2/400 |
| 3,819,095 | A | * | 6/1974 | Synder | 224/248 |
| 4,151,937 | A | * | 5/1979 | Jarosh et al. | 206/315.1 |
| D252,422 | S | * | 7/1979 | Gillenwater | D2/400 |
| D274,830 | S | * | 7/1984 | Lynch | D21/234 |
| 4,957,232 | A | * | 9/1990 | Sprague | 224/674 |
| 4,960,239 | A | * | 10/1990 | Wait | 224/918 |
| 4,993,126 | A | * | 2/1991 | Collins | 24/336 |
| 5,054,777 | A | * | 10/1991 | Borden et al. | 15/113 |
| 5,553,345 | A | * | 9/1996 | Bell | 15/209.1 |
| D374,472 | S | * | 10/1996 | Nowak | D21/234 |
| 5,799,853 | A | * | 9/1998 | Brewster | 224/245 |
| 6,202,911 | B1 | * | 3/2001 | Freer | 224/223 |
| 6,220,973 | B1 | * | 4/2001 | Hsu | 473/406 |
| D458,756 | S | * | 6/2002 | Smith | D3/318 |

* cited by examiner

*Primary Examiner*—Lee Young
*Assistant Examiner*—Lien Ngo
(74) *Attorney, Agent, or Firm*—Wallace F Neyerlin

(57) ABSTRACT

A golf accessory holder device designed to be held in a compartment of a belt clip and frequently inserted and removed therefrom during the golfer's round of golf, and to prevent damage to or soiling of the pocket or the pocket entry area which frequently occurs when a golfer keeps such accessories in his pocket; said device having smooth top and bottom surfaces and having the capability of firmly holding one or two tees, a ball marker, a green ball mark repair tool, and a towel, one end of said device being so constructed as to be particularly adapted for firmly gripping the towel, but also adapted that the towel can be easily released from the device and also easily re-inserted into same. One embodiment includes a unique combination of the device with the ball mark repair tool. Another embodiment includes a unique combination of the device with the belt clip.

10 Claims, 5 Drawing Sheets

GOLF ACCESSORY HOLDER AND CLIP THEREFOR

BACKGROUND OF THE INVENTION

FIELD OF THE INVENTION AND BACKGROUND DISCUSSION

This invention relates to a device of special interest to golfers, particularly golfers who wear clothing with pockets when golfing. As all golfers know, there are many items used by a golfer during a round of golf besides the golf balls, golf clubs, and golf bag. The items being referred to are such things as tees, ball markers, green ball mark repair tools, brushes for cleaning the faces of the golf clubs and items for cleaning the grooves in the golf club faces. Such items are typically kept in the pockets of the golfer, and inserted in the pocket and removed from same several times during the course of the golfer's round. Golfers also generally have towels affixed to their golf bags while golfing.

Most golfers are generally attired in fairly expensive athletic clothing, particularly at country clubs, etc., while golfing. The repeated insertion and removal of items such as the above-described can cause holes in the bottoms of the pockets; and/or soiling the sides of the pockets, requiring frequent dry cleaning of the clothing, etc. Often, also the golfer might have the desire to use his towel, but is at a place remote from where his bag with the towel is located; for example, on a green remote from his golf bag or golf cart.

This invention relates to a multi-purpose pocket-saver golf accessory holder of unique construction and design along with a clip therefor which will accomplish many objectives as will become apparent after a review of the drawings and claims.

Applicant is aware that many devices have been patented having some of the items as just referred to, but it is believed that the device of this invention possesses several distinctions over what is taught in the prior art references and also possesses several advantages over these prior art devices.

SUMMARY OF THE INVENTION

It is an object of this invention to design a device (hereinafter referred to as a "pocket saver golf caddy") that will hold a number of the accessory items as referred to above, specifically including; a ball mark divot repair tool; one or two tees; a ball marker; and means for clamping a small towel at one end of the device.

It is another object of this invention to design such a pocket caddy as above referred to that will have substantially smooth planar top and bottom surfaces and smooth (preferably curved) side surfaces so as to be able to easily be inserted into and easily withdrawn from a belt clip to be worn on the belt of the golfer.

It is another object of this invention to design such a pocket caddy that will clamp onto a small towel or terry cloth at one of its ends and that will enable the towel to be easily attached to and easily removed from the device.

It is another object of the invention to design such a device that will function as above in combination with the belt clip, that will also overcome the potential problems of the golfer's pockets, or entrances thereof, become worn or dirty or holes punched in the pockets.

It is another object of this invention to design such a device as to offer the convenience for the golfer to carry a small towel with him at all times; this being accomplished by having one end of the towel attached to the device.

It is another object of this invention to design such a device that will firmly hold the removable accessory items, i.e., the tees, the ball marker, and the ball mark repair tool, but at the same time permit their easy removal from the device and easy replacement onto or into the device.

It is another object of this invention to design such a device that will firmly hold a ball mark repair tool or divot fixer, but which repair tool(s) can be easily separated from the device and stuck in the ground to support a club grip thereon when the ground is wet.

It is another object of this invention to coordinate the design of the ball mark repair tool with the design of the "pocket caddy" device such that the repair tool can also have a sharp pointed edge to clean golf club grooves; said ball mark repair tool also having a forked opening in its opposite end for assisting in pulling tees out of the ground or for supporting club grip ends of clubs and prevent the club grips from getting wet when the ground is dewy or wet.

It is another object of this invention to design such a device so that its smooth top or bottom surfaces are suitable or conducive to be used for advertising purposes; either directly in the surface during the manufacturing or the device; and/or by having advertising stickers glued thereon after manufacturing of the device has been completed.

It is another object of this invention to design such a golf accessory holder as can accomplish all of the foregoing objectives; and at the same time be constructed from a single integral piece of molded plastic or a minimum number of parts so as to minimize fabrication or assembly labor cost and be of economically attractive manufacturing cost.

BRIEF DESCRIPTION OF THE DRAWINGS

FIG. 1 being a top view; FIG. 1*c* a bottom view.

FIG. 2 being a side view of the belt clip and of an accessory holder compartment of the belt clip; FIG. 2*b* being a top view.

FIG. 3 being a side view; FIG. 3*b* being a cross-sectional view.

FIG. 4 being a top view; FIG. 4*b* being a bottom view.

DETAILED DESCRIPTION OF THE DRAWINGS AND OF THE PREFERRED EMBODIMENTS

The accessory holder device of this invention is preferably comprised of a single main element which can be produced from a suitable plastic composition in a molding operation. The top and bottom surfaces of the device are preferably very smooth. The device has openings and grooves therein (as referred to hereinafter) formed during the molding operation.

The holder device itself is referred to generically, by the numeral 1. The device has a top surface 4, which may be used for advertising as hereinbefore mentioned. Numeral 2 in the various Figures depicts a slot for holding a small towel or terry cloth. The cloth is held by tension in the slot beneath the top and bottom surfaces of the holding device. Many commercial plastics on the market are of suitable strength and flexibility to perform this function of firmly gripping and holding a towel and/or releasing the towel from the slot countless times without damage or breakage of the device itself.

Numeral 3 depicts a hole for tensioned holding of the ball marker 5. Numeral 6 depicts golf tees which are positioned in slots 10 of the holder device.

Figure 1A:
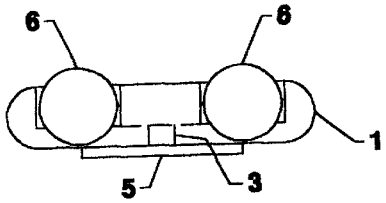
FIG. 1*a* is a cross-sectional view.
Figure 1:
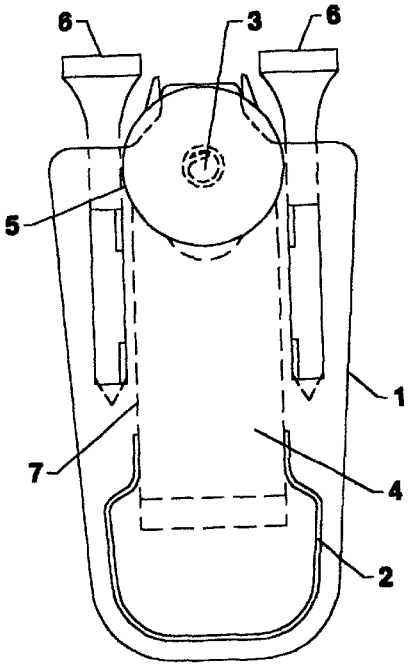
FIGS. 1 through 1*c* are accessory assembly views.
Figure 1B:
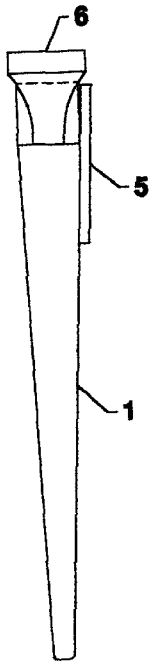
FIG. 1*b* being a side view.
Figure 1C:
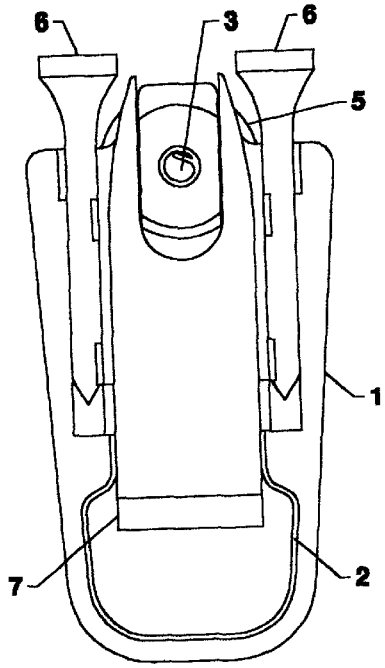
Figure 2B:
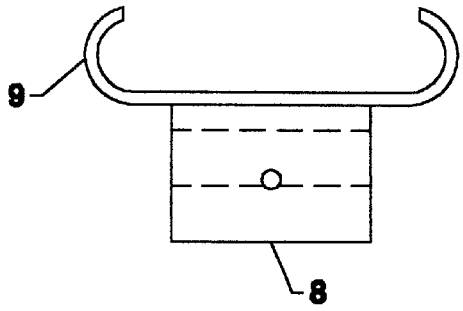
FIGS. 2 through 2*b* are belt clip assembly views.
Figure 2:
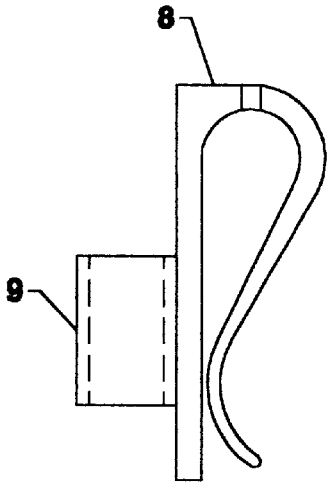
Figure 2A:
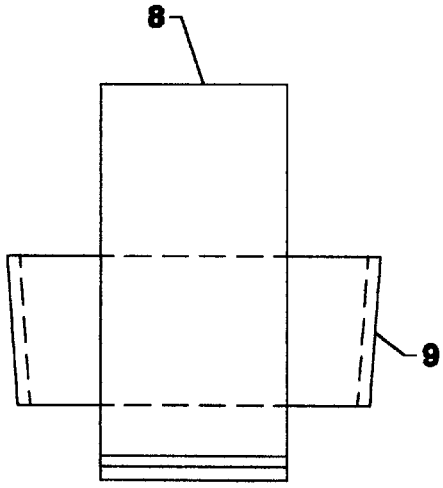
FIG. 2*a* being a plan view of the belt clip and holder compartment.
Figure 5:
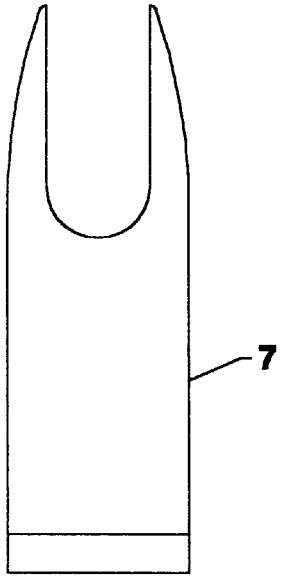
FIGS. 5 and 5*a* are views of the club cleaner/divot fixer.
Figure 5A:
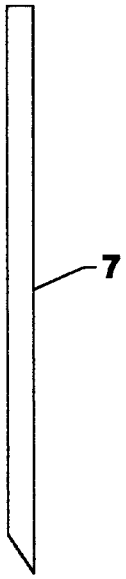
Figure 6:
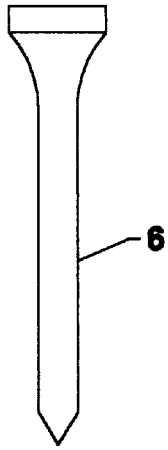
FIG. 6 shows a golf tee.
Figure 7A:
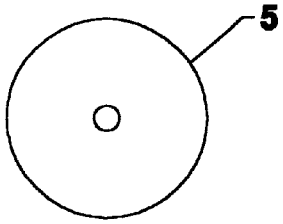
FIGS. 7 and 7*a* depict a ball marker for use in marking the position or location of a ball on the "green" of the hole.
Figure 7:
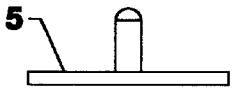

Numeral 7 depicts a club cleaner/divot fixer which is held in position on the bottom surface of the device by means of clamping the forked ends of the divot fixer around a portion of the bottom surface of the holder as illustrated in FIG. 1*c*. FIG. 5 shows that this club cleaner has a straight line end and FIG. 5*a* shows this straight line end to be a sharp pointed edge.

Figure 3B:
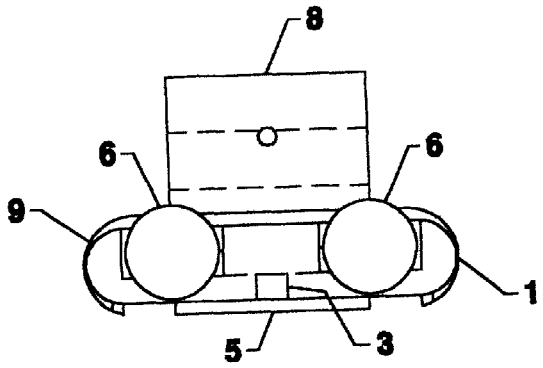
FIGS. 3 through 3*b* are complete assembly views of the accessory holder into the belt clip and belt clip compartment.
Figure 3:
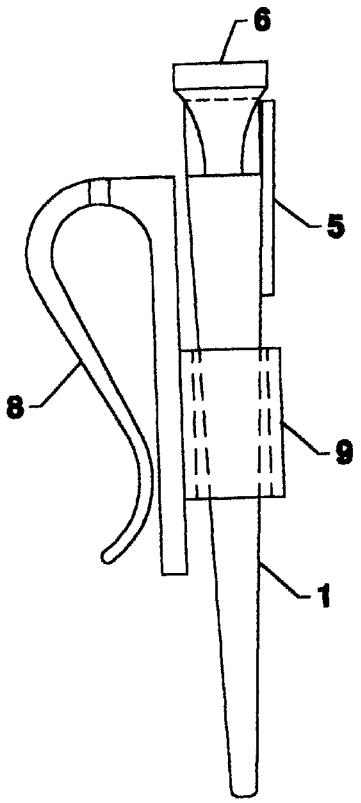
Figure 3A:
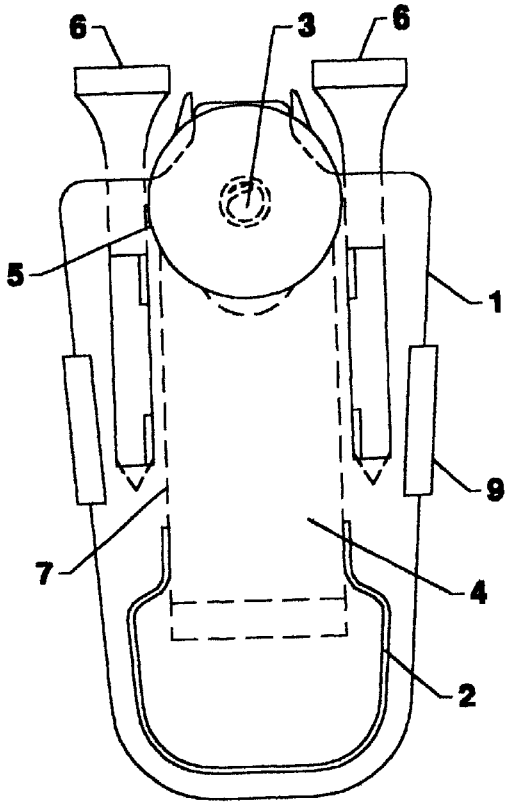
FIG. 3*a* being a top view.
Figure 4A:
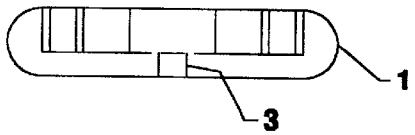
FIG. 4*a* being a cross-sectional view.
Figure 4:
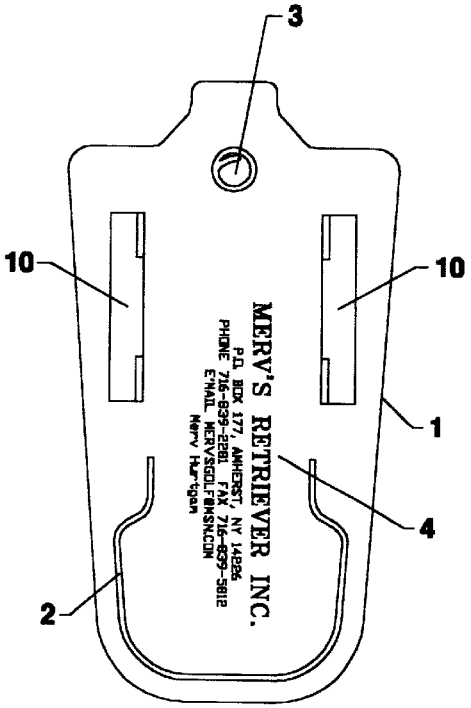
FIGS. 4 through 4*b* are accessory holder only views.
Figure 4B:
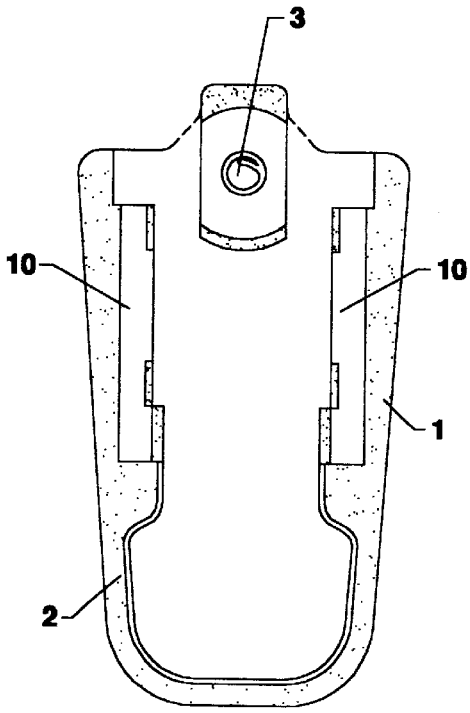

Numeral 8 depicts the belt clip used to be fastened over the belt of the golfer, typically at his back; and Numeral 9 depicts a compartment of the belt clip for holding the golf accessory device. When inserted fully into the holder compartment of the belt clip, the accessory device will preferably be gripped in the compartment near its middle as illustrated in FIG. 3.

The rearward portion of the top surface of the accessory holding device has ample room for advertising space of a company or a club logo, etc. Such advertising can be accomplished either in the molding of the device or by attachment of separate stickers, etc.

The front end of the device is designed to have one or two curved recesses therein, one or both of which will have an opening 10 therein for accommodating the insertion and holding of a golf tee 6 therein. The front end of the device will generally be thicker than the tail end, front end typically being about ½ inch thick and the tail end being about ¼ inch thick; and the device typically being about 5 inches long.

Openings 10 for the tees preferably have nodes therein to hold the tees in place; and opening 3 also preferably has nodes therein to hold the ball marker in place.

The device is constructed of flexible rigid plastic. The holder's towel gripping design is such as to provide the desired friction to hold the towel in place, but at the same time to permit easy removal of the towel from the device and easy replacement therein whenever desired.

The coordinated design or combination of the accessory holder device and the belt clip and compartment thereof as aforedescribed is considered novel with the invention; as is also the novel design of the golf accessory device itself; and as is also the coordinated design and combination of the accessory holder device and the ball mark repair tool.

The foregoing description and embodiments are intended to illustrate the invention without limiting it thereby. It will be understood that various modifications can be made in the invention without departing from the spirit or scope thereof.

I claim:

1. A golf accessory holder device designed to be held in a compartment of a belt clip and frequently inserted and removed therefrom during the golfer's round of golf, and to prevent damage to or soiling of a pocket or a pocket entry area which frequently occurs when a golfer keeps such accessories in his pocket, said device having smooth top and bottom surfaces and having the capability of firmly holding one or two tees, a ball marker, a ball mark repair tool, and a towel, one end of said device being constructed of plastic and having a slot therein between the top and bottom surfaces of the holder device so as to define a deflectable tab particularly adapted for firmly gripping the towel by tension but also adapted that the towel can be easily released from the device and also easily re-inserted into said device.

2. A golf accessory holder device according to claim 1 wherein the ball mark repair tool has means for cleaning club faces.

3. A golf accessory holder device according to claim 1 wherein the device is constructed of a single piece of molded plastic.

4. In combination, a golf accessory holder device and a ball mark repair tool, said holder device being designed to be held in a compartment of a belt clip and frequently inserted and removed therefrom during the golfer's round of golf, and to prevent damage to or soiling of a pocket or a pocket entry area which frequently occurs when a golfer keeps such accessories in his pocket, said device having smooth top and bottom surfaces and having the capability of firmly holding one or two tees, a ball marker, the ball mark repair tool, and a towel, one end of said device being constructed of plastic and having a slot therein between the top and bottom surfaces of the holder device so as to define a deflectable tab particularly adapted for firmly gripping the towel by tension but also adapted that the towel can be easily released from the device and also easily re-inserted into said device; and said ball mark repair tool being tensionally attached to the bottom of the device by a forked end of the repair tool releasably gripping a bottom portion of the device.

5. A combination according to claim 4 wherein said ball mark repair tool has a sharp straight-line pointed end opposite the forked end, said straight-line pointed end being useful for cleaning grooves in the clubs of the golfer using the repair tool.

6. A combination according to claim 4 wherein the forked end of the ball mark repair tool is suitable for efficiently extracting tees from the ground.

7. A golf accessory device according to claim 1 wherein the top surface of the device has ample room for advertising space thereon.

8. A combination according to claim 4 wherein the top surface of the device has ample room for advertising space therein.

9. In combination, a golf accessory holder device and a belt clip to hold the golf accessory device when said device is not in use, said accessory device having smooth top and bottom surfaces and having the capability of firmly holding one or two tees, a ball marker, a ball mark repair tool, and a towel, one end of said device being constructed of plastic and having a slot therein between the top and bottom surfaces of the holder device so as to define a deflectable tab particularly adapted for firmly gripping the towel by tension, but also adapted that the towel can be easily released from the device and also easily re-inserted into said device; said accessory holder device sloping rearwardly with a gradually diminishing width.

10. A combination according to claim 9 wherein the top surface of the device has ample room for advertising thereon.

* * * * *